United States Patent [19]

Driver

[11] 4,051,908

[45] Oct. 4, 1977

[54] DOWNHOLE DRILLING SYSTEM

[76] Inventor: W B Driver, 19 Sheridan Road, Arnold, Md. 21012

[21] Appl. No.: 739,106

[22] Filed: Nov. 5, 1976

[51] Int. Cl.[2] ..... E21B 7/04

[52] U.S. Cl. ..... 175/78

[58] Field of Search ..... 175/78, 79, 81

[56] References Cited

U.S. PATENT DOCUMENTS

| | | | |
|---|---|---|---|
| 2,500,785 | 3/1950 | Arutunoff | 175/78 |
| 2,516,421 | 7/1950 | Robertson | 175/78 |
| 2,906,499 | 9/1959 | Travis | 175/78 |
| 3,797,576 | 3/1974 | Azalbert et al. | 175/78 |

*Primary Examiner*—James A. Leppink

[57] ABSTRACT

According to the invention an improved system for the drilling of small holes from and at right angles to a vertical well hole. The system is directed by a ninety degree elbow attached to the downhole end of a small diameter tube section. The uphole end of the tube section is attached to the downhole end of a large diameter tubing string. A downhole electrical motor operates the drilling part of the system from inside the large diameter tubing string. The drive part of the system which operates the drill bit consists of a pump, which also provides drilling fluids to the drill bit, a small diameter drill pipe, a flexible drill pipe which operates the drill bit from around the ninety degree elbow. An electrical mechanical cable provides power to the electrical motor and hoists the electrical motor and its attachments in and out of the tubing string. An anti-torque mechanism attached to the uphole end of the electrical motor holds the electrical motor in place when the electrical motor is in operation.

2 Claims, 2 Drawing Figures

DOWNHOLE DRILLING SYSTEM

BACKGROUND OF THE INVENTION

1. Field of the Invention

This invention relates to the equipments and systems used to drill small holes in the wall of large diameter well holes, particularly small horizontal holes that are drilled at right angles to the large well hole.

2. Prior Art

There have been several systems designed for the boring of small diameter holes in the wall of a large diameter well hole, but they have mostly been ineffective due to the problems of low rotation speed of drilling with downhole fluid motors or drill pipe because this type of drilling requires large pressure on the drill bit which tends to cause the flexible drill pipes particularly wire wound pipes to fail. There has been electrical powered systems designed but these systems have been very limited in the depth or length of small holes that can be drilled from a well hole. All systems drill pipe, fluid motor or electrical motor also have another limitation in that they are suspended in a well hole by drill pipe and require considerable time in the hoisting of the systems in and out of a well hole that would be required in the drilling of a pattern of small holes all the way around a well hole.

SUMMARY OF THE INVENTION

An objective of the invention is to provide a means of rotary drilling of small holes from a well hole.

An objective is to provide a system that can be operated down a well hole by wire.

An objective is to provide the above mentioned drilling system with its own circulation capability or flushing system that can use air, water or other fluids in a well hole to flush cuttings from a small hole being drilled.

Another objective of the invention is to provide a downhole drilling system that can rapidly be removed and replaced in a well hole so additional links of flexible drill pipe can be added to drill small holes at greater depths or lengths from the well hole.

Another objective of the invention is provide a system that can use downhole electrical motors of different lengths and horse power.

DESCRIPTION OF THE DRAWINGS

In the accompanying drawings.

DESCRIPTION OF THE PREFERRED EMBODIMENT

Figure 1:
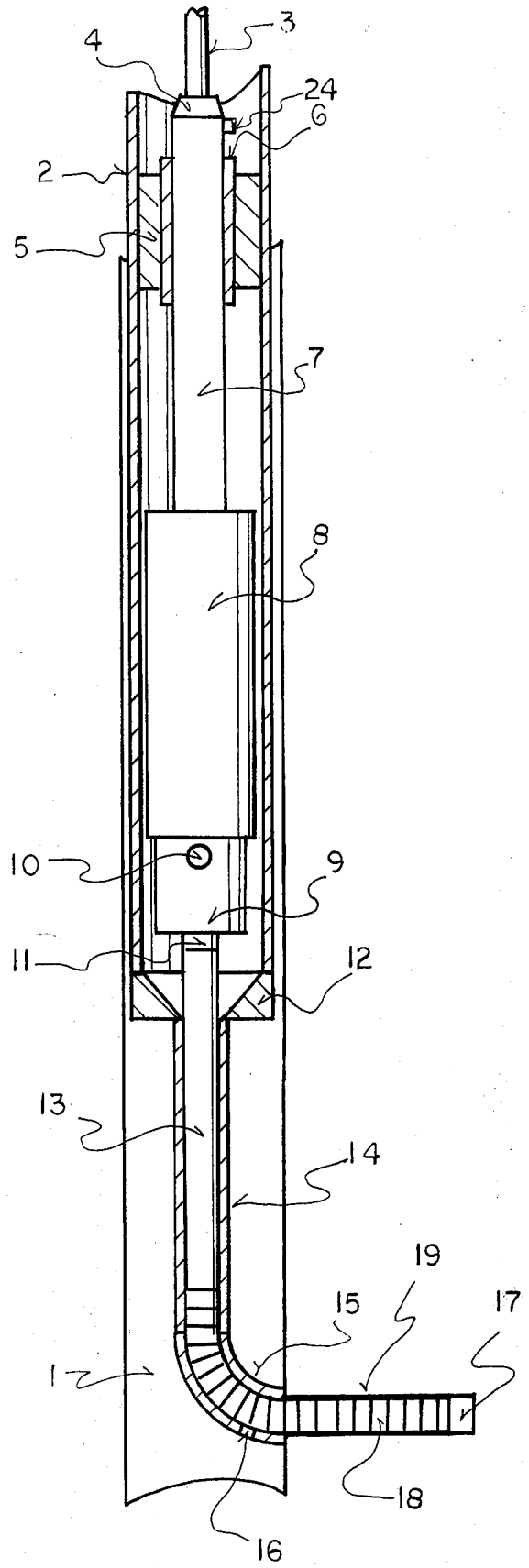
FIG. 1 illustrates the total downhole drilling system, cross sections of the large diameter tubing string, the small diameter tube section, the tube fitting, the ninety degree elbow, the packer and the square tube are shown. The lengths of the elements in respect to their width or the length of some elements in respect to the lengths of other elements are drawn out of proportion so the total system could be illustrated.

As shown in FIG. 1 the downhole drilling system is drilling a small hole 19 in the wall of well hole 1. The downhole end of large diameter tubing string 2 is connected by tube fitting 12 to the uphole end of small diameter tube section 14. One end of ninety degree elbow 15 is connected to the downhole end of small diameter tube section 14. The other end of ninety degree elbow 15 interfaces with the wall of well hole 1 where a small hole 19 is being drilled. The objective of the large diameter tubing string 2, tube fitting 12, small diameter tube section 14 and ninety degree elbow 15 is to support and guide the actual drilling part of the system to a point where a small hole 17 is to be drilled. Drill bit 17 is attached to the downhole end of wire wound flexible drill pipe 18. The uphole end of wire wound flexible drill pipe 18 is connected to the downhole end of drill pipe stem 13. The uphole end of drill pipe stem 18 is connected to the open end of hollow rod 11. The closed end of hollow rod 11 is connected to the downhole end of pump rotor 22 of pump 9. The uphole end of pump rotor 22 is connected to the downhole end of output shaft 21 of downhole electrical motor 8. The downhole end of square pipe 7 is connected to the uphole end of downhole electrical motor 8. Cable connector 4 connects the uphole end of square pipe 7 to an end portion of electrical mechanical cable 3. Electrical mechanical cable 3 extends through cable connector 4, square pipe 7 and connects to the uphole end of downhole electrical motor 8 and supplies electrical power to downhole electrical motor 8. Square tube 6 is large enough to slip over square pipe 7 but will not let square pipe 7 turn inside of square tube 6. Packer 5 is constructed to and around square tube 6. The drilling part of the system is powered by downhole electrical motor 8. Downhole electrical motors have the design characteristics of being small in diameter and long in length. To increase the horse power of this type of motor the length is generally increased and the diameter stays the same so motors of different horse power can be used in the same diameter well hole or tubing string. So the system uses this type of electrical motor because diameter is a very limited factor while length is not. Another reason an electrical motor is used to power the system is because an electrical motor is not influenced by downhole well pressure in restricting output power as would be the case when using a drill pipe or fluids motor system. The primary important reason though is because an electrical motor can operate in a well hole environment at much higher revolutions per minute than drill pipe or fluid motor systems. This is most important because the higher the revolutions per minute the less drill bit pressure is required. The wire wound flexible drill pipe 18 can operate and drill with high revolutions per minute and low drill bit pressure. The wire wound flexible drill pipe 18 would fail if used with drill pipe or fluid motor systems because of the high drill bit pressure that would be required because of the low revolutions per minute of these systems. Pump 9 is of the advancing cavity type pump with a helical shaped rotor.

Figure 2:
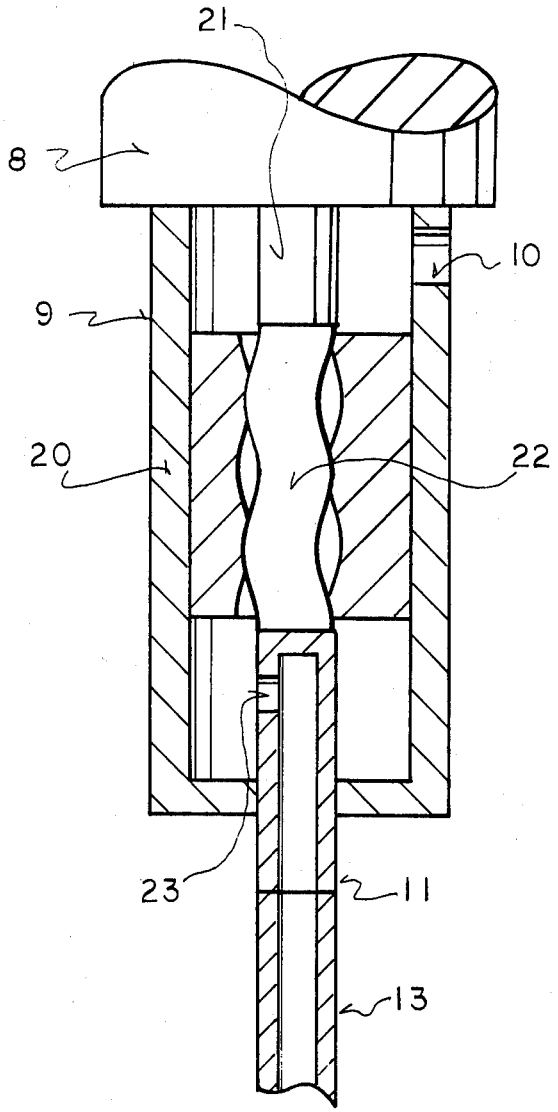
FIG. 2 illustrates a cross section of the pump showing how the rotor of the pump is used in the drive train for the bit and how fluids would be pumped from inside the tubing string or well hole through the hollow rod into the small diameter drill stem.

This type of pump is used because pumps of a large volume can be constructed with a small diameter. See FIG. 2. Output port 23 is constructed through the wall of hollow rod 11 near the closed end of hollow rod 11. The housing 20 of pump 9 is attached to the downhole end of downhole electrical motor 8 and extends over and enclosed output port 23. Intake port 10 is constructed through housing 20 of pump 9 above the uphole end of pump rotor 22. The pump 9 pumps air, water or other fluids from inside large diameter tubing string 2 or well hole 1 through intake port 10, through output port 23, through hollow rod 11, through drill pipe stem 13, through wire wound flexible drill pipe 18, through drill bit 17 and flushes cuttings from small hole 19 through exhaust hole 16 into well hole 1. The system configured as described above provides its own system for removing cuttings from a small hole 17 being drilled. The electrical mechanical cable 3 suspends the electrical motor 8 in the large diameter tubing string 2, provides power to the electrical motor 8 and is used to hoist the actual drilling part of the system in and out of the large diameter tubing string 2, so the system actually drills by wire and since it can rapidly be removed and replaced in large diameter tubing string 2 it would be feasible to hoist the system out of large diameter tubing string 2 and add additional lengths of wire wound flexible drill pipe 18 to drill small hole 19 to greater distances from well hole 1. Since the downhole electrical motor 8 is suspended by electrical mechanical cable 3 there is a need for an anti-torque mechanism to hole the system in place while a small hole 19 is being drilled. This anti-torque mechanism consists of square pipe 7, square tube 6 and packer 5. Packer 5 is of the type that is activated by rotation and released by an uphole pulling force. The inside of square tube 6 is large enough to slip over square pipe 7 but will not let square pipe 7 turn inside of square tube 6. Before the downhole electrical motor 8 is started the downhole end of square tube 6 rests on the uphole end of downhole electrical motor 8. When downhole electrical motor 8 is started back rotation of downhole electrical motor 8 causes packer 5 to activate and anchor itself against the inside wall of large diameter tubing string 2 and through square tube 6 holds square pipe 7 and downhole electrical motor 8 in place while a small hole 19 is being drilled. As the small hole 19 is being drilled square pipe 7 slips down through square tube 6 until the small hole 19 is drilled. After small hole 19 has been drilled electrical mechanical cable 3 pulls square pipe 7 through square tube 6 until the downhole end of square tube 6 interfaces with the uphole end of downhole electrical motor 8 and then an uphole pulling force is applied to packer 5 and packer 5 releases so the drilling part of the system can be hoisted up through large diameter tubing string 2. The inside diameter of small diameter tube section 14 is large enough to let drill pipe stem 13 and wire wound flexible drill pipe 18 operate through but will hole wire wound flexible drill pipe 18 straight and not let wire wound flexible drill pipe 18 flex when operating. The length of small diameter tube section 14 is greater than the length of the wire wound flexible drill pipe 18 so no part of wire wound flexible drill pipe 18 will extend into tube fitting 12 or large diameter tubing string 2 when wire wound flexible drill pipe 18 is operating. The length of drill pipe stem 13 is longer than both tube fitting 12 and small diameter tube section 14 so the maximum amount of wire wound flexible drill pipe 18 can be used in the drill of a small hole 19. The inside diameter of the downhole end of tube fitting 12 is equal to the inside diameter of small diameter tube section 14. The inside diameter of the uphole end of tube fitting 12 is equal to the inside diameter of the large diameter tubing string 2. The inside wall of tube fitting 12 diverges from the downhole end to the uphole end forming a funnel shaped passage so drill bit 17 and wire wound flexible drill pipe 18 can pass from the large diameter tubing string 2 to the small diameter tube section 14 without hanging up. The length of square tube 6 is greater than packer 5 so packer 5 will not interface with the uphole end of downhole electrical motor 8. The length of square pipe 7 is greater than the length of square tube 6 and this difference in length is greater than the length of drill pipe stem 13 so the maximum utilization of drill pipe stem 13 through tube fitting 12 and small diameter tube section 14 can be provided. Metal arm 24 extends from one side of square pipe 7 and is connected to square pipe 7 near the uphole end of square pipe 7. The length of metal arm 24 extends to the outside of square tube 6 and keeps square tube 6 from slipping over the uphole end of square pipe 7 while being lowered into large diameter tubing string 2.

Basically the downhole drilling system consists of two subsystems which provide guidance and an actual drilling function. The large diameter tubing string 2 and its associated attachments is the guidance part of the downhole drilling system. The downhole electrical motor 8 and its associated attachments is the actual drilling part of the downhole drilling system. The large diameter tubing string 2 and its associated attachments guide the downhole electrical motor 8 and its associated attachments so that a small hole 19 will be drilled at a desired point from and at a right angle to a well hole 1. Another significant feature of the downhole drilling system is the downhole electrical motor 8 is a primary structure member of the actual drilling part of the system so motors of different lengths and horse power can be used with the downhole drilling system without any major modifications or design changes.

I claim:

1. Wherein the invention an improved downhole drilling system for the boring of small holes from and at right angles to a larger well hole, and the system comprises, a large diameter tubing string lowered in said well hole, a tube fitting, a small diameter tube section, said fitting attaches the uphole end of said section to the downhole end of said string, a ninety degree elbow, one end of said elbow being attached to the downhole end of said section, one end of said elbow interfaces with the wall of said well hole where a small hole is to be drilled, an electrical mechanical cable, a downhole electrical motor, said cable suspends and provides power to said motor in said string, said cable hoist said motor in and out of said string, a square pipe, a cable connector, said connector connects the uphole end of said square pipe to an end portion of said cable, said cable extends through said connector through said square pipe and connects to the uphole end of said motor, downhole end of said square pipe connects to the uphole end of said motor, a pump being of the advancing cavity type, rotor of said pump being helical shaped, output shaft of said motor connects to the uphole end of said rotor, a hollow rod, one end of said rod being open, one end of said rod being closed, closed end of said rod attached to the downhole end of said rotor, an output port through the wall of said rod near the closed end of said rod, housing of said pump connects to the downhole end of said motor and extends over and enclosed said output port, and input port through said housing above the uphole end of said rotor, a wire wound flexible drill pipe, a drill bit attached to the downhole end of said flexible drill pipe, a drill pipe stem, uphole end of said drill pipe stem attached to the open end of said rod, downhole end of said stem attached to the uphole end of said flexible drill pipe, inside diameter of the downhole end of said fitting equal to the inside diameter of said section, inside diameter of the uphole end of said fitting equal to the inside diameter of said string, inside wall of said fitting diverges for the downhole end of said fitting to the uphole end of said fitting forming a funnel shaped passage so said bit, flexible drill pipe and stem can feed into said section without hanging up, inside diameter of said section being large enough to let said bit pass through and said flexible drill pipe and said stem operate inside said section but hole said flexible drill pipe straight, length of said section being longer than the length of said flexible drill pipe, length of said stem being longer than both the length of said fitting and length of said section, an exhaust hole through the wall of said elbow near end of said elbow that interfaces with wall of said well hole, said pump pumps air, water or other fluids from inside of said string or well hole through said rod, said stem, said flexible drill pipe and said bit to flush cuttings from said small hole through said exhaust hole into said well hole, a square tube, a packer being of the type activated by rotation and released by an uphole pulling force and being shorter in length than said square tube, said packer constructed to and around said square tube, inside of said square tube being large enough to slip over said square pipe but not let said square pipe turn inside said square tube, length of said square pipe greater than the length of said square tube, difference in length of said square pipe and said square tube being greater than the length of said stem so the maximum length of said stem can be used when drilling said small hole, back swing when said motor starts causes said packer to activate and anchor to inside wall of said string and through said square tube eliminating rotation of said square pipe and said motor while a small hole is being drilled, said square pipe slips down through said square tube while a said small hole is being drilled, after said small hole is drilled said cable pulls said square pipe up through said square tube until the downhole end of said square tube interfaces with the uphole end of said motor and through said square tube an uphole pulling force is applied to said packer and causes said packer to release, a metal arm extending from one side of said square pipe near the uphole end of said square pipe keeps said square tube from slipping over the uphole end of said square pipe while being lowered in said string, length of said arm extends to the outside of square tube.

2. In claim 1 after a small hole has been drilled additional links of wire wound flexible drill pipe are attached between the downhole end of said stem and the uphole end of said flexible drill pipe so said small hole can be drilled at greater depths or lengths.

* * * * *